US006883318B2

(12) United States Patent
Warner et al.

(10) Patent No.: US 6,883,318 B2
(45) Date of Patent: Apr. 26, 2005

(54) METHOD OF CONTROLLING AN INTERNAL COMBUSTION ENGINE

(75) Inventors: Oliver A. Warner, Brighton, MI (US); Mark A. Zurawski, Northville, MI (US); Andrew May, Wauwatosa, WI (US)

(73) Assignee: Detroit Diesel Corporation, Detroit, MI (US)

( * ) Notice: Subject to any disclaimer, the term of this patent is extended or adjusted under 35 U.S.C. 154(b) by 148 days.

(21) Appl. No.: 10/424,246

(22) Filed: Apr. 28, 2003

(65) Prior Publication Data

US 2004/0016232 A1 Jan. 29, 2004

Related U.S. Application Data

(60) Provisional application No. 60/398,737, filed on Jul. 26, 2002.

(51) Int. Cl.[7] ..... F02B 33/44; F02D 13/04

(52) U.S. Cl. ..... 60/602; 123/321; 123/322

(58) Field of Search ..... 60/602–603; 123/320, 123/321, 322; 701/100

(56) References Cited

U.S. PATENT DOCUMENTS

| | | | | |
|---|---|---|---|---|
| 6,050,093 | A * | 4/2000 | Daudel et al. | 60/602 |
| 6,148,793 | A | 11/2000 | Faletti et al. | 123/322 |
| 6,256,992 | B1 * | 7/2001 | Lewis et al. | 60/603 |
| 6,543,226 | B1 * | 4/2003 | Bischoff et al. | 60/602 |
| 6,560,963 | B1 * | 5/2003 | Cornell et al. | 60/602 |
| 6,665,604 | B1 * | 12/2003 | Arnold | 60/602 |
| 2002/0157395 | A1 * | 10/2002 | Scherngell et al. | 60/602 |
| 2003/0149522 | A1 * | 8/2003 | Arnold | 701/100 |

* cited by examiner

*Primary Examiner*—Thai-Ba Trieu
(74) *Attorney, Agent, or Firm*—Brooks Kushman P.C.

(57) ABSTRACT

A method of controlling an internal combustion engine when the engine is operating in an engine braking mode is provided. The engine operates in the engine braking mode and an exhaust valve for the cylinder is prematurely opened to dissipate power. The method includes controlling airflow to at least one cylinder based on a comparison of a desired mass airflow rate and an actual mass airflow rate such that the actual mass airflow rate tracks the desired mass airflow rate.

20 Claims, 4 Drawing Sheets

METHOD OF CONTROLLING AN INTERNAL COMBUSTION ENGINE

CROSS-REFERENCE TO RELATED APPLICATIONS

This application claims the benefit of U.S. provisional application Ser. No. 60/398,737 filed Jul. 26, 2002.

BACKGROUND OF THE INVENTION

1. Field of the Invention

The present invention relates to a method of controlling an internal combustion engine when the engine is operating in an engine braking mode.

2. Background Art

The heavy duty engine business is extremely competitive. Increasing demands are being placed on engine manufacturers to design and build engines that provide better engine performance, improved reliability, and greater durability. One feature on some existing engines is engine braking. Engine brakes, or retarders, are used to assist and supplement wheel brakes in slowing heavy vehicles. Engine brakes are desirable because they help alleviate wheel brake overheating. Known engine compression brakes convert an internal combustion engine from a power-generating unit into a power-consuming air compressor by prematurely opening an exhaust valve of at least one cylinder to dissipate power.

The control system for a compression brake mechanism on an engine with a traditional fixed geometry turbocharger utilizes an engine control module algorithm that among other things, senses throttle and a dash mounted multi-position switch. Using the switch, the vehicle operator sets and limits the number of cylinders in brake mode and therefore the general brake power level whenever throttle goes to zero fueling. Typically, the engine control module activates six, four, or two cylinders. The engine then operates along a high, medium, or low brake power curve as engine speed varies due to grade changes. Such a control system provides relatively stable control for vehicle speed as varying grades are encountered because as speed increases or decreases, brake power increases or decreases, respectively. The vehicle operator selects a general brake level with the multi-position switch and selects a transmission gear based on the operator's judgment of traction conditions, desired mean vehicle speed down the grade, and desired speed variability.

In some applications, tighter vehicle speed control is provided by closed loop vehicle speed control. The number of cylinders in braking mode is determined by the magnitude of the vehicle speed error from a driver determined speed set point. Typically, this implementation is done in a step wise fashion with the number of braking cylinders increasing as the speed error increases. Such a technique provides fuel economy benefits by delaying brake power increases until some acceptable over speed occurs.

However, although the above techniques have been utilized in some applications that have been commercially successful, there are sources of brake power variability over which the driver has no control. For example, the braking power curves vary as altitude and ambient temperature change. That is, brake power decreases as altitude increases. Further, colder inlet temperatures result in increases brake power. Other sources of brake power variability include turbocharger part-to-part variability, accumulated wear and damage, manifold leaks, etc. An existing engine compression braking apparatus is shown in U.S. Pat. No. 6,148,793.

For the foregoing reasons, there is a need for a method of controlling an internal combustion engine when the engine is operating in an engine braking mode that provides improved control over braking power.

SUMMARY OF THE INVENTION

It is, therefore, an object of the present invention is to provide a method of controlling an internal combustion engine when the engine is operating in an engine braking mode that utilizes closed loop control based on mass airflow rate.

In carrying out the above object and other objects of the present invention, a method of controlling an internal combustion engine when the engine is operating in an engine braking mode is provided. The engine has at least one cylinder and an intake manifold that supplies a controllable airflow to the at least one cylinder. When the engine is operating in the engine braking mode, an exhaust valve for the cylinder is prematurely opened to dissipate power. The method comprises determining a desired mass airflow rate to the at least one cylinder when the engine is operating in the engine braking mode, and determining an actual mass airflow rate to the at least one cylinder when the engine is operating in the engine braking mode. The method further comprises comparing the desired mass airflow rate to the actual mass airflow rate, and controlling the airflow based on the comparison such that the actual mass airflow rate tracks the desired mass airflow rate.

In a preferred embodiment, determining the desired mass airflow rate further comprises determining a desired braking level, and determining an engine speed. The desired mass airflow rate is determined based on the desired braking level, and the engine speed.

Further, in a preferred embodiment, determining the actual mass airflow rate further comprises determining an engine speed, determining an intake manifold air pressure, and determining an intake manifold air temperature. The actual mass airflow rate is determined based on the engine speed, the intake manifold air pressure, and the intake manifold air temperature.

More preferably, determining the actual mass airflow rate further comprises determining a number of braking cylinders and determining a correction factor based on the number of braking cylinders. The actual mass airflow rate is determined based on the engine speed, the intake manifold air pressure, the intake manifold air temperature, and the correction factor. The correction factor accounts for the volumetric efficiency of the cylinders, depending on the number of braking cylinders.

In a preferred embodiment, controlling the airflow further comprises determining a mass airflow rate error based on the comparison and determining a plurality of control terms. The airflow is controlled based on the mass airflow rate error and the plurality of control terms.

More preferably, the method further comprises determining a desired braking level, determining an engine speed, and determining a feed forward term based on the desired braking level, and the engine speed. The airflow is controlled based on the mass airflow rate error, the plurality of control terms, and the feed forward term.

In a preferred implementation, the engine includes a variable geometry turbocharger. Controlling the airflow further comprises varying the geometry of the turbocharger based on the comparison. Of course, it is appreciated that alternative embodiments of the present invention may control the airflow in other ways. For example, a wastegated turbocharger or a controllable supercharger may be utilized to control the airflow.

In a preferred implementation where the engine includes a variable geometry turbocharger, varying the geometry of the turbocharger further comprises determining a braking turbocharger geometry based on the comparison of the desired mass airflow rate to the actual mass airflow rate. A turbocharger actual speed is determined, and a turbocharger maximum speed is established. The method further comprises comparing the turbocharger actual speed to the turbocharger maximum speed, and determining a limit turbocharger geometry. The limit turbocharger geometry is based on the comparison of the turbocharger actual speed to the turbocharger maximum speed. The limit turbocharger geometry is compared to the braking turbocharger geometry, and the turbocharger geometry is varied based on the comparison of the limit turbocharger geometry to the braking turbocharger geometry.

In some implementations, the method further comprises determining a plurality of braking levels based on engine operating conditions, and selecting a desired braking level from the plurality of braking levels. An engine speed is determined, and the desired mass airflow rate is determined based on the desired braking level and the engine speed. The plurality of braking levels may include, for example, a first braking level based on a position of a dash input switch, a second braking level based on a status of a cruise control, and/or a third braking level based on engine operating conditions.

Further, in carrying out the present invention, an engine controller including a computer readable storage medium having instructions stored thereon, and an engine including the engine controller, are provided. The instructions direct the engine controller to perform a method of controlling the internal combustion engine when the engine is operating in an engine braking mode. The engine has at least one cylinder and an intake manifold that supplies a controllable airflow to the at least one cylinder. When the engine is operating in the engine braking mode, an exhaust valve for the cylinder is prematurely opened to dissipate power. The medium further comprises instructions for determining a desired mass airflow rate to the at least one cylinder when the engine is operating in the engine braking mode, and instructions for determining an actual mass airflow rate to the at least one cylinder when the engine is operating in the engine braking mode. The medium further comprises instructions for comparing the desired mass airflow rate to the actual mass airflow rate, and instructions for controlling the airflow based on the comparison such that the actual mass airflow rate tracks the desired mass airflow rate. In a preferred embodiment, various additional instructions are provided for implementing various other features of the present invention.

The advantages associated with embodiments of the present invention are numerous. For example, internal combustion engines, in accordance with the present invention, may be operated in an engine braking mode in which closed loop control closed around mass airflow rate is utilized to provide controlled engine braking. It is appreciated that the closed loop around mass airflow rate varies the airflow to assure that the actual mass airflow rate tracks the desired mass airflow rate during engine braking. As such, the closed loop control will compensate for brake power variability.

The above object and other objects, features, and advantages of the present invention are readily apparent from the following detailed description of the preferred embodiment when taken in connection with the accompanying drawings.

DETAILED DESCRIPTION OF THE PREFERRED EMBODIMENT

Figure 1:
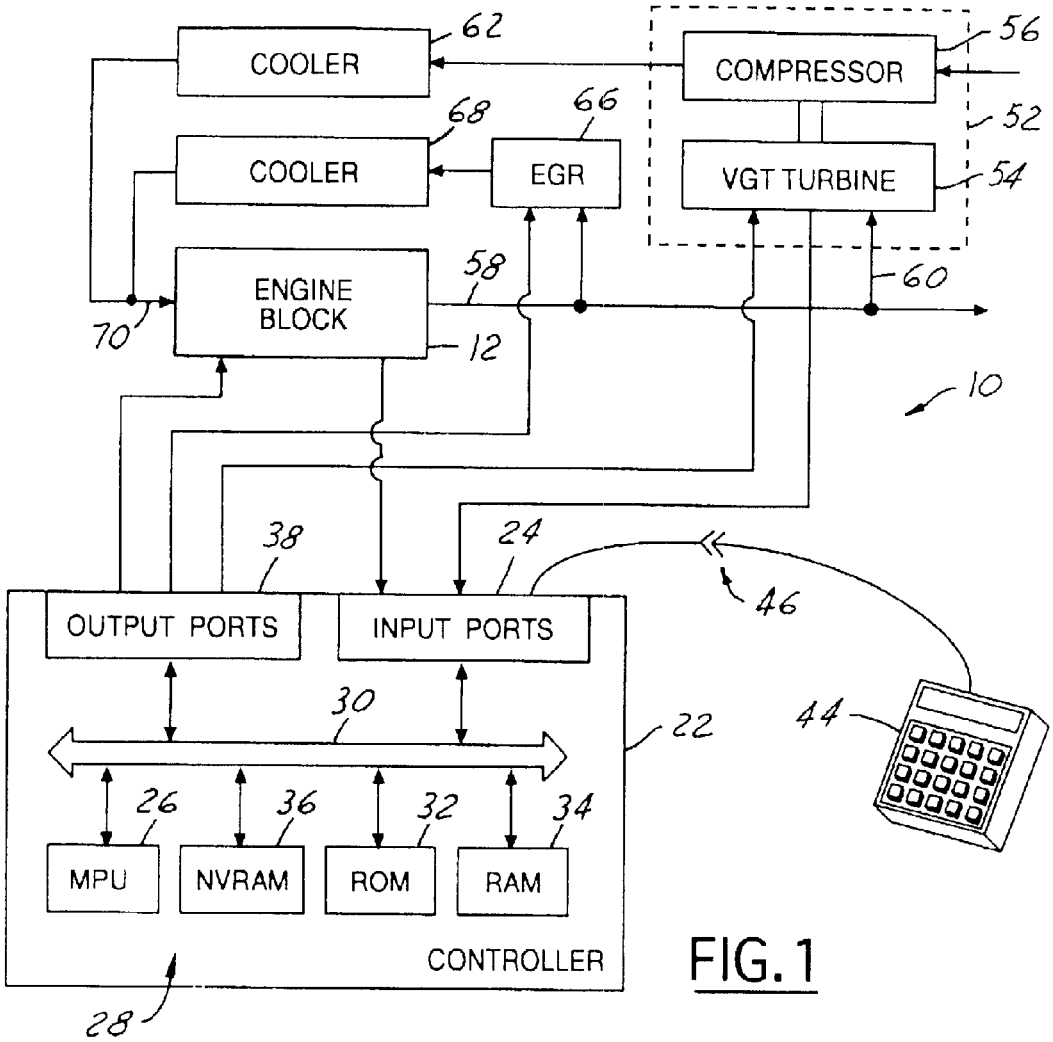
FIG. 1 is a schematic diagram of an internal combustion engine and an engine control system made in accordance with an embodiment of the present invention.

In FIG. 1, an internal combustion engine including associated control systems and subsystems is generally indicated at 10. Engine or system 10 includes an engine block 12 having a plurality of cylinders. In a preferred embodiment, engine 10 is a compression-ignition internal combustion engine, such as a heavy duty diesel fuel engine. The cylinders receive pressurized fuel from a fuel supply in a known manner. Block 12 represents intake and exhaust manifolds and valves, as well as other standard engine components in addition to representing the engine block.

Various sensors are in electrical communication with a controller 22 via input ports 24. Controller 22 preferably includes a microprocessor 26 in communication with various computer readable storage media 28 via data and control bus 30. Computer readable storage media 28 may include any of a number of known devices which function as read only memory 32, random access memory 34, and non-volatile random access memory 36.

Computer readable storage media 28 have instructions stored thereon that are executable by controller 22 to perform methods of controlling the internal combustion engine, including exhaust gas recirculation (EGR) valve 66 and turbocharger 52. The program instructions direct controller 22 to control the various systems and subsystems of the vehicle, with the instructions being executed by microprocessor 26. Input ports 24 receive signals from various sensors, and controller 22 generates signals at output ports 38 that are directed to the various vehicle components.

A data, diagnostics, and programming interface 44 may also be selectively connected to controller 22 via a plug 46 to exchange various information therebetween. Interface 44 may be used to change values within the computer readable storage media 28, such as configuration settings, and/or calibration variables.

In operation, controller 22 receives signals from the various vehicle sensors and executes control logic embedded in hardware and/or software to control the engine. In a preferred embodiment, controller 22 is the DDEC controller available from Detroit Diesel Corporation, Detroit, Mich. Various other features of this controller are described in detail in a number of different U.S. patents assigned to Detroit Diesel Corporation.

As is appreciated by one of ordinary skill in the art, control logic may be implemented in hardware, firmware, software, or combinations thereof. Further, control logic may be executed by controller 22, in addition to by any of the various systems and subsystems of the vehicle cooperating with controller 22. Further, although in a preferred embodiment, controller 22 includes microprocessor 26, any of a number of known programming and processing techniques or strategy may be used to control an engine in accordance with the present invention.

Controller 22 provides enhanced engine performance by controlling a variable flow exhaust gas recirculation (EGR) valve 66 and by controlling turbocharger 52. Turbocharger 52 includes a turbine 54 and a compressor 56. The pressure of the engine exhaust gases causes the turbine to spin. The turbine drives the compressor, which is typically mounted on the same shaft. The spinning compressor creates turbo boost pressure which develops increased power during combustion. The exhaust gases pass from engine 12 through exhaust passage 58 and are selectively routed to turbine 54 at inlet 60. The present invention may be utilized in engines with or without a turbocharger.

That is, it is appreciated that embodiments of the present invention control the airflow to at least one cylinder based on a comparison of desired mass airflow rate and actual mass airflow rate. In embodiments of the present invention that utilize a turbocharger, a variable geometry turbocharger is preferred. However, some alternative embodiments may utilize a wastegated turbocharger. In a variable geometry turbocharger, the turbine housing is oversized for an engine, and the airflow is choked down to the desired level.

There are several designs for the variable geometry turbocharger. In one design, a variable inlet nozzle has a cascade of movable vanes which are pivotable to change the area and angle at which the airflow enters the turbine wheel. In another design, the turbocharger has a movable sidewall which varies the effective cross-sectional area of the turbine housing.

An exhaust gas recirculation system introduces a metered portion of the exhaust gases into the intake manifold. The EGR system dilutes the incoming fuel charge and lowers combustion temperatures to reduce the level of oxides of nitrogen. The amount of exhaust gas to be recirculated is controlled by EGR valve 66. It is appreciated that there are many possible configurations for an EGR valve, and embodiments of the present invention are not limited to any particular structure for the EGR valve. Further, it is appreciated that embodiments of the present invention may be employed in engines with or without an EGR system.

In some embodiments, it may be desirable to provide a cooler 62 to cool the charge air coming from compressor 56. Similarly, in some embodiments, it may be desirable to provide a cooler 68 to cool the flow through the EGR system prior to reintroduction to engine 12 of the gases at intake passage 70. The flow path from EGR valve 66 through cooler 68 illustrates a high pressure EGR system. In embodiments of the present invention that have an EGR system, the EGR system may alternatively be a low pressure EGR system where the exhaust gas is taken from the exhaust stream downstream of the turbine and introduced at the compressor inlet.

Figure 2:
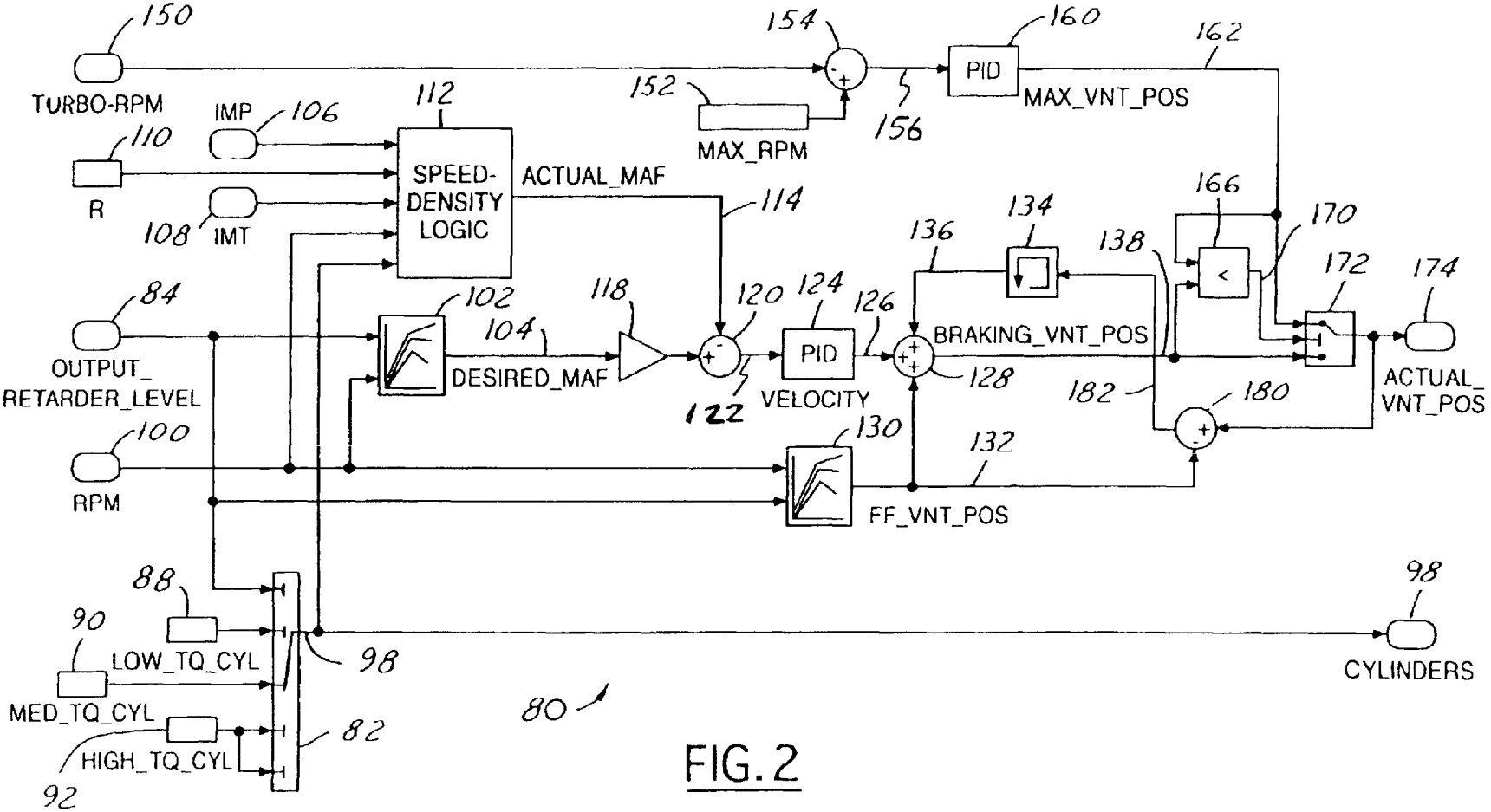

With reference to FIG. 2, a control system of the present invention is generally indicated at 80. Control system 80 receives a plurality of inputs and determines a vane position for a variable inlet nozzle turbocharger. That is, upon replacement of a fixed geometry turbocharger with a variable geometry turbocharger, the control method to achieve the customary brake power operating curves becomes more complicated. There is no longer a direct relationship between brake power, the number of brake active cylinders, and the engine speed. Because variable geometry turbochargers can deliver a range of pressures, the geometry must be controller to establish a brake power curve. In the embodiment illustrated, the variable geometry turbocharger is used as a variable vane mechanism to control pressure. However, this is not the only configuration to which embodiments of the present invention are applicable.

In accordance with the present invention, a brake mode engine control algorithm is performed by the engine control module to achieve power control with a variable geometry turbocharger by means of closed loop air mass flow control. This technique recognizes the fundamental, unique relationship of brake power to the mass of air inducted into the cylinders, regardless of atmospheric and turbo boost conditions such as air temperature and pressure. A preferred embodiment of the present invention coordinates the number of cylinders in brake mode with the turbo geometric control because different combinations of these outputs achieve a given power at a given speed. In addition to the usual throttle, clutch, and dash switch inputs, embodiments of the present invention utilize an intake manifold absolute pressure sensor and an intake manifold temperature sensor. These sensors are customary for power mode operation of the engine. However, other sensoring calculation methods for air mass flow can be used such as hot wire anemometry. The dash input switch, instead of determining the number of braking cylinders, determines the desired brake power curve (for example, low, medium, or high). Turbocharger geometry is controlled based on a comparison of desired air mass flow rate with an actual air mass flow rate. The actual air mass flow rate may be determined in a number of different ways, such as via speed-density calculations.

As best shown in FIG. 2, multi-port switch 82 receives output retarder level 84. Output retarder level 84 represents a desired braking level. Multi-port switch 82, based on output retarder level 84, determines the appropriate number of braking cylinders 98. That is, multi-port switch 82 selects from discrete inputs 88, 90, and 92. Block 88 represents the number of cylinders used for braking on the low torque curve, block 90 represents the number of cylinders on the medium torque curve, and block 92 represents the number of cylinders on the high torque curve. Control system 80 also receives engine speed input 100. Lookup table 102 determines a desired mass airflow rate to the engine when the engine is operating in the engine braking mode. Lookup table 102 is indexed by output retarder level 84 and engine speed 100. The desired mass airflow 104 passes through gain block 118 to summer 120. Block 118 may be used to increase or decrease braking. For example, block 118 preferably has unity gain but may have more or less gain to provide increased or decreased percentage of braking. Because the closed loop control is based on mass airflow rate, an actual mass airflow rate must also be determined.

Speed-density logic 112 receives intake manifold pressure 106, gas constant 110, and intake manifold temperature 108, in addition to receiving engine speed 100 and number of braking cylinders 98. Speed-density logic 112 determines the actual mass airflow rate 114. Of course, and as mentioned previously, other techniques may be utilized for determining the actual mass airflow rate and speed-density logic is one example of how to perform such calculations. Actual mass airflow rate 114 is received by summer 120 and a comparison at summer 120 determines an error 122. Error 122 is provided to control terms 124 to produce signal 126. In a preferred implementation, control terms 124 are represented by a proportional/integral/derivative controller in the velocity form. The velocity form for PID control 124 means that the output of controller 124 is a commanded position difference as opposed to a commanded position, and that memory is provided so that output 126 is summed with previously commanded actual vane positions at summer 128.

In a preferred implementation, output retarder level 84 and engine speed 100 are utilized to provide a feed-forward term. As shown, feed-forward lookup table 130 has an output 132 fed to summer 128. The feed-forward term may quickly provide a commanded vane position while the feed-back control based on mass airflow rate makes minor adjustments to compensate for when the mass airflow rate is greater or less than a desired amount. Output 138 of summer 128 is provided to relational operator 166 and switch 172. Relational operator 166 and switch 172 assure that the turbo does not over speed which may damage the turbocharger. More specifically, system 80 also receives turbo speed 150 and maximum turbo speed 152 as inputs. Turbo speed 150 and maximum turbo speed 152 are compared at summer 154 to determine an error 156. Error 156 passes through PID controller 160 to determine a maximum vane position 162. That is, as the turbo approaches the maximum speed, closed loop control based on a speed error may cause the turbocharger speed to track the maximum speed if the braking vane position commanded is greater than the maximum allowable position 162. Specifically, output 170 of block 166 causes switch 172 to choose a smaller value of inputs 162 and 138 and pass that value out as the actual or commanded vane position 174. As such, in the event that, for example, a vehicle is accelerating down a slope such that substantial braking is needed, but the vehicle is at higher altitudes and the application of the desired braking would cause the turbo to over speed, the turbo vane position is limited by output 162 of PID controller 160 as determined by relational operator 166 and switch 172.

As mentioned previously, memory 134 has output 136 fed to summer 128 because PID controller 124 is in the velocity form. Memory 134 receives its value as the commanded vane position 174 less the feed-forward vane position 132, as indicated by summer 180 and output 182. In turn, output 136 of memory 134 assures that the commanded vane position takes into consideration the previously commanded vane position as well as the velocity error and change in the feed-forward term.

Figure 3:
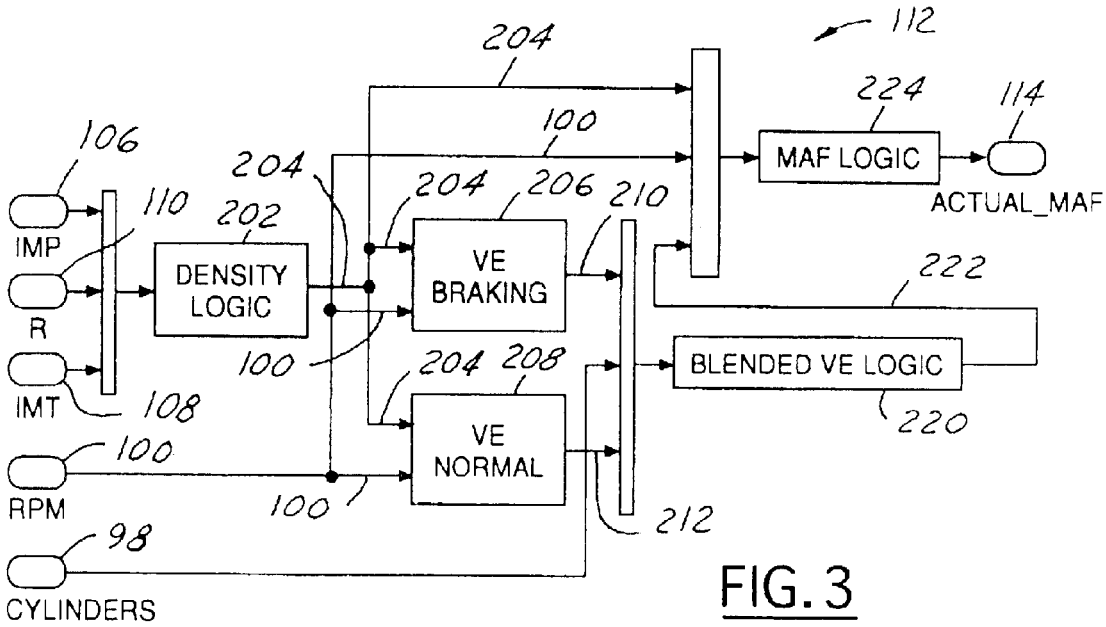
FIGS. 2–4 are control system diagrams illustrating a preferred method of the present invention.

In FIG. 3, speed-density logic 112, in a preferred embodiment, is more clearly illustrated. Intake manifold pressure 106, gas constant 110, intake manifold temperature 108, engine speed 100, and number of braking cylinders 98 are received as inputs. Air density 204 is determined by density logic 202 based on pressure, temperature, and the gas constant. Volumetric efficiency during braking is determined at block 206, while volumetric efficiency of a non-braking cylinder is determined at block 208. Volumetric efficiency is based on density 204 and engine speed 100. Output 210 of volumetric efficiency for braking cylinders block 206 and output 212 of volumetric efficiency for normal, non-braking cylinders block 208 are used along with the number of braking cylinders 98 to determine a blended volumetric efficiency. Blended volumetric efficiency logic 220 has output 222 representing a blended volumetric efficiency. Because the number of braking cylinders may vary, for example, in a six-cylinders engine all six cylinders may be used for braking on the medium and high brake torque curves while only three cylinders may be used while braking on the low braking torque curve. As such, blended volumetric efficiency logic 220 blends the volumetric efficiency values for braking cylinders 210 and non-braking cylinders 212 to determined a blended volumetric efficiency 220. In a suitable implementation, the blended volumetric efficiency is a sum of the product of braking cylinder volumetric efficiency 210 and the ratio of braking to total cylinders and the product of non-braking cylinder volumetric efficiency 212 and the ratio of non-braking to total cylinders. Blended volumetric efficiency 222, engine speed 100, and density 204 are used by mass airflow logic 224 to determine the actual mass airflow rate 114.

Figure 4:
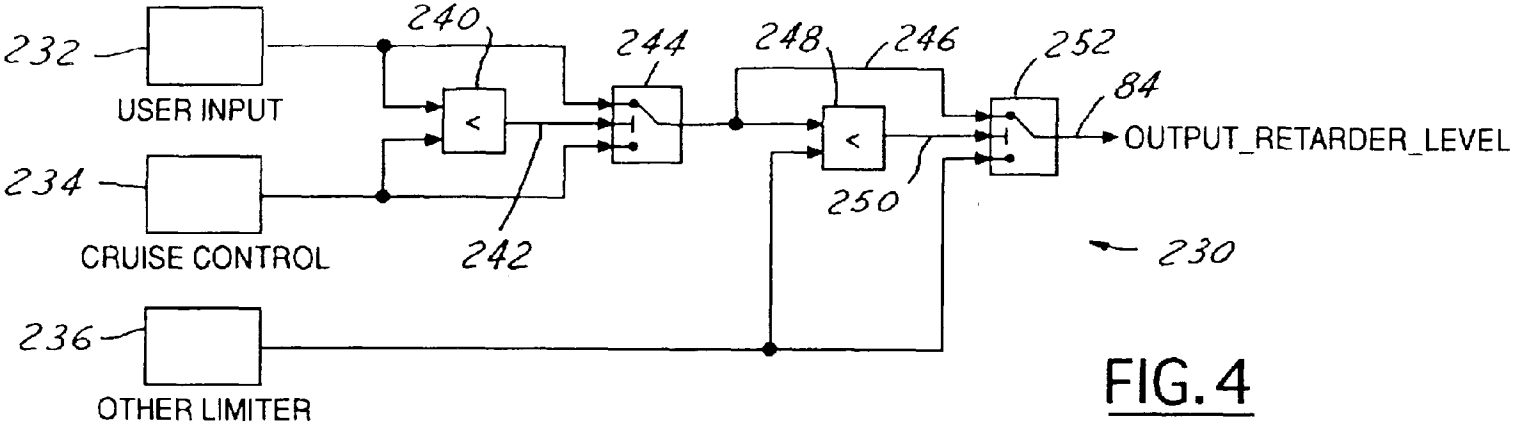

In FIG. 4, as mentioned previously, output retarder level 84 may come from a number of sources. A diagram 230 illustrates determining output retarder level 84. User input 232 from a dash input switch (for example, off, low, medium, or high), cruise control logic input 234, and any other limiter 236 are received. Relational operator block 240 chooses the lesser of user input 232 and cruise control input 234. Output 242 of block 240 causes switch 244 to choose the lesser value and to pass that value to output 246. Block 248 chooses the lesser of output 246 and a value from any other brake limiter 236. Output 250 of relational block 248 causes switch 252 to choose the smaller value and pass that value on as the output retarder value 84. As such, the user may determine a braking level with a dash input switch. In addition, cruise control may determine the braking level based on a vehicle speed error. As shown in diagram 230, effective braking during cruise control may be limited by the dash input switch.

Figure 5:
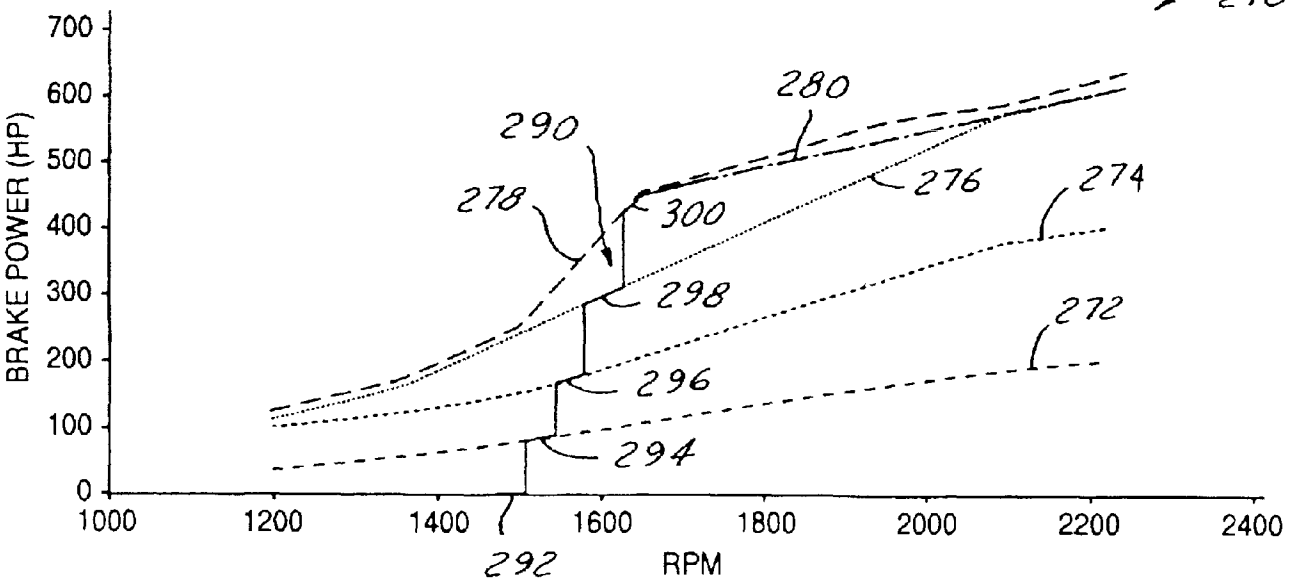
FIG. 5 is a graph depicting brake power versus engine speed, including low, medium, and high brake power curves.

In FIG. 5, the graphs 270 depict various brake power curves. The graphs indicate brake power on the ordinate and engine speed on the abscissa. The low braking power curve is indicated at 272. The medium braking power curve is indicated at 274. The high braking power curve is indicated at 276. A constant torque curve 280 is also illustrated. In addition, maximum braking or drive line capability is indicated at 278. When the dash input switch is used as the selected braking power curve, braking follows one of three curves 272, 274, or 276. Appropriate desired mass airflow is determined and the actual vane position is determined in accordance with engine speed and the output retarder level appropriate for the needed brake power.

When cruise control is used, the engine may step through the various brake power curves based on vehicle speed error. Line 290 illustrates the various braking modes when cruise control is being used. For example, the vehicle is slowly accelerating down a grade. At 292, the vehicle is traveling at less than 0.5 miles per hour over the driver selected set point. At 294, the vehicle is traveling between 0.5 miles per hour and 1 mile per hour over the set point. At 296, the vehicle is traveling between 1 mile per hour and 1.5 miles per hour over the set point. At 298, the vehicle is traveling between 1.5 miles per hour and 2 miles per hour over the set point. That is, as vehicle speed error increases, the engine steps from no braking, to low braking, to medium braking, and to high braking. Further, for safety purposes, the engine may step above the high braking curve if speed error continues to increase. At 300, the braking power is shown following a constant torque curve 280 slightly below the drive line capability 278. Braking may be limited for other reasons besides driveline protection, such as for anti-lock purposes.

It is appreciated that, in accordance with the present invention, for a given engine and turbocharger configuration, test cell determination of number of cylinders in brake mode, turbo geometry control driver, air mass flow, volumetric efficiency, and intake manifold air density for each of the desired brake power curves versus engine speed is required. Additionally, gain values for the PID controllers should be determined based on transient response and stability criteria. In addition, the diagrams shown are exemplary and other variations are possible. For example, other methods for closed loop control implementation such as adaptive memory replacing the feed-forward table or a self-tuning regulator replacing the PID controller (in the main controller) are possible.

Figure 6:
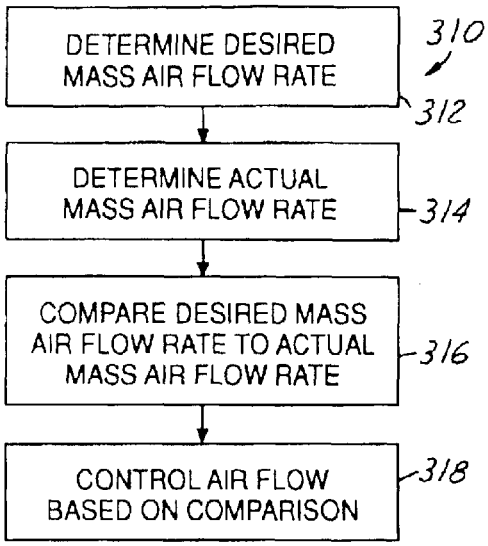
FIGS. 6–9 are block diagrams illustrating a preferred method of the present invention.

FIGS. 6–9 illustrate various methods of the present invention. In FIG. 6 at 310, block 312 illustrates determining a desired mass airflow rate. At block 314, an actual mass airflow rate is determined. At block 316, the desired mass airflow rate is compared to the actual mass airflow rate. At block 318, airflow is controlled based on the comparison such that the actual mass airflow rate tracks the desired mass airflow rate. That is, FIG. 3 broadly illustrates embodiments of the present invention that may be implemented utilizing various techniques to control airflow including a variable geometry turbocharger and using various techniques for determining the actual mass airflow rate such as a speed-density calculation or direct sensing.

Figure 7:
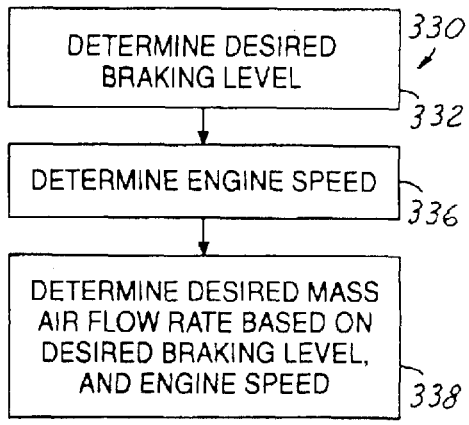

In FIG. 7, generally indicated at 330, a method of the present invention for calculating the desired mass airflow rate is illustrated. At block 332, a desired braking level is determined (FIG. 2, output retarder level 84). At block 336, an engine speed is determined. At block 338, desired mass airflow rate is determined based on desired braking level, and engine speed (FIG. 2, look-up table 102).

Figure 8:
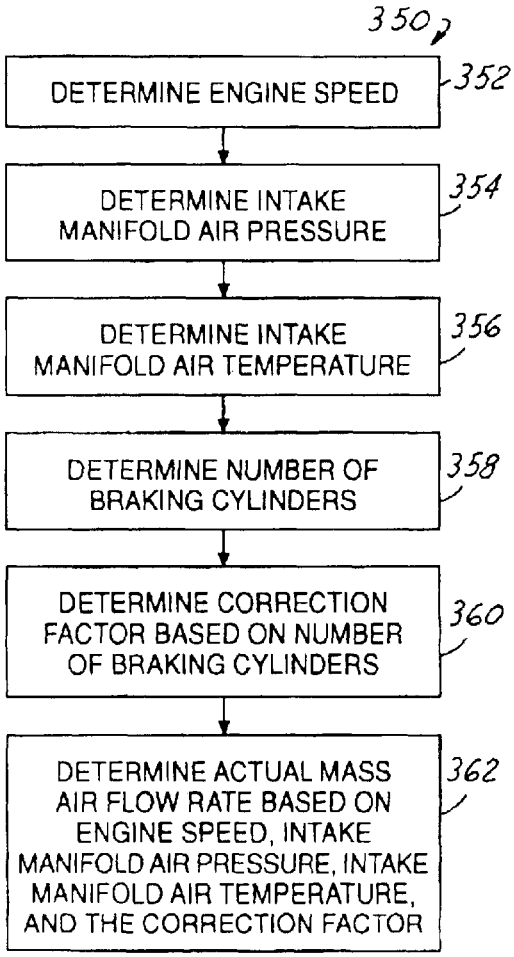

In FIG. 8, a method for determining actual mass airflow rate is generally indicated at 350. At block 352, engine speed is determined. At block 354, intake manifold air pressure is determined. At block 356, intake manifold air temperature is determined. At block 358, number of braking cylinders is determined. At block 360, a correction factor is determined based on the number of braking cylinders (volumetric efficiency as described previously). At block 362, actual mass airflow rate is determined based on engine speed, intake manifold air pressure, intake manifold air temperature, and the correction factor.

Figure 9:
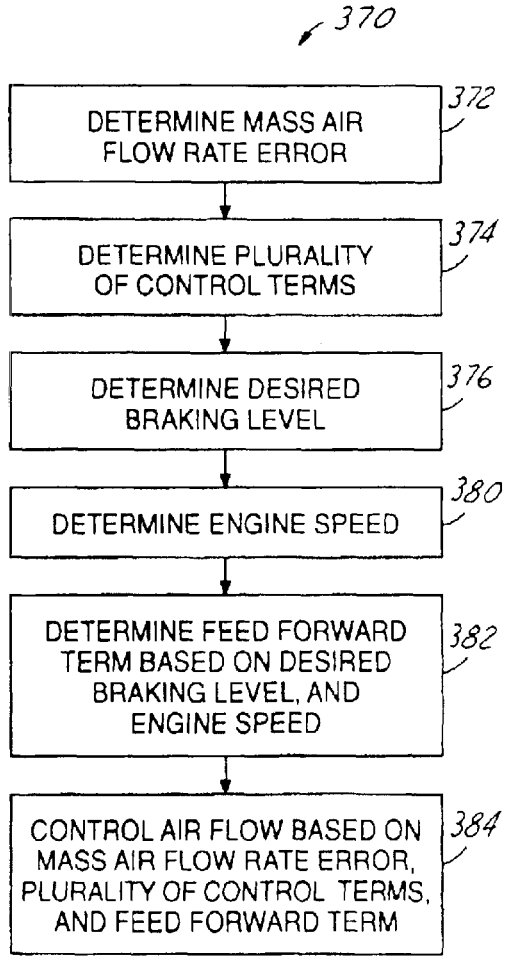

In FIG. 9, yet another method of the present invention is generally indicated at 370. At block 372, mass airflow rate error is determined. At block 374, a plurality of control terms are determined. At block 376, desired braking level is determined. At block 380, engine speed is determined. At block 382, a feedforward term is determined based on desired braking level, and engine speed. At block 384, airflow is controlled based on mass airflow rate error, the plurality of control terms, and the feedforward term.

While the best mode for carrying out the invention has been described in detail, those familiar with the art to which this invention relates will recognize various alternative designs and embodiments for practicing the invention as defined by the following claims.

What is claimed is:

1. A method of controlling an internal combustion engine when the engine is operating in an engine braking mode, the engine having at least one cylinder and an intake manifold that supplies a controllable airflow to the at least one cylinder, wherein when the engine is operating in the engine braking mode an exhaust valve for the cylinder is prematurely opened to dissipate power, the method comprising:

determining a desired mass airflow rate to the at least one cylinder when the engine is operating in the engine braking mode;

determining an actual mass airflow rate to the at least one cylinder when the engine is operating in the engine braking mode;

comparing the desired mass airflow rate to the actual mass airflow rate: and controlling the airflow based on the comparison such that the actual mass airflow rate tracks the desired mass airflow rate, wherein determining the actual mass airflow rate further comprises:

determining an engine speed;

determining an intake manifold air pressure;

determining an intake manifold air temperature;

determining a number of braking cylinders;

determining a correction factor based on the number of braking cylinders; and determining the actual mass airflow rate based on the engine speed, the intake manifold air pressure, the intake manifold air temperature, and the correction factor.

2. The method of claim 1 wherein determining the desired mass airflow rate further comprises:

determining a desired braking level;

determining an engine speed; and determining the desired mass airflow rate based on the desired braking level, and the engine speed.

3. The method of claim 1 wherein controlling the airflow further comprises:

determining a mass airflow rate error based on the comparison;

determining a plurality of control terms; and controlling the airflow based on the mass airflow rate error and the plurality of control terms.

4. The method of claim 3 further comprising:

determining a desired braking level;

determining an engine speed;

determining a feed forward term based on the desired braking level, and the engine speed; and controlling the airflow based on the mass airflow rate error, the plurality of control terms, and the feed forward term.

5. A method of controlling an internal combustion engine when the engine is operating in an engine braking mode, the engine having at least one cylinder and an intake manifold that supplies a controllable airflow to the at least one cylinder, wherein when the engine is operating in the engine braking mode an exhaust valve for the cylinder is prematurely opened to dissipate power, the method comprising:

determining a desired mass airflow rate to the at least one cylinder when the engine is operating in the engine braking mode;

determining an actual mass airflow rate to the at least one cylinder when the engine is operating in the engine braking mode;

comparing the desired mass airflow rate to the actual mass airflow rate; and controlling the airflow based on the comparison such that the actual mass airflow rate tracks the desired mass airflow rate, wherein the engine includes a variable geometry turbocharger, and wherein controlling the airflow further comprises:

varying the geometry of the turbocharger based on the comparison.

6. The method of claim 5 wherein varying the geometry of the turbocharger further comprises:

determining a braking turbocharger geometry based on the comparison of the desired mass air flow rate to the actual mass air flow rate;

determining a turbocharger actual speed;

establishing a turbocharger maximum speed;

comparing the turbocharger actual speed to the turbocharger maximum speed;

determining a limit turbocharger geometry based on the comparison of the turbocharger actual speed to the turbocharger maximum speed;

comparing the limit turbocharger geometry to the braking turbocharger geometry; and varying the geometry based on the comparison of the limit turbocharger geometry to the braking turbocharger geometry.

7. A method of controlling an internal combustion engine when the engine is operating in an engine braking mode, the engine having, at least one cylinder and an intake manifold that supplies a controllable airflow to the at least one cylinder, wherein when the engine is operating in the engine braking mode an exhaust valve for the cylinder is prematurely opened to dissipate power, the method comprising:

determining a desired mass airflow rate to the at least one cylinder when the engine is operating in the engine braking mode;

determining an actual mass airflow rate to the at least one cylinder when the engine is operating in the engine braking mode;

comparing the desired mass airflow rate to the actual mass airflow rate; and controlling the airflow based on the comparison such that the actual mass airflow rate tracks the desired mass airflow rate, wherein determining the desired mass airflow rate further comprises:

determining a plurality of braking levels based on engine operating conditions;

selecting a desired braking level from the plurality of braking levels;

determining an engine speed; and determining the desired mass air flow rate based on the desired braking level, and the engine speed.

8. The method of claim 7 determining a plurality of braking levels further comprises:

determining a first braking level based on a position of a dash input switch.

9. The method of claim 8 wherein determining a plurality of braking levels further comprises:

determining a second braking level based on a status of a cruise control.

10. The method of claim 9 wherein determining a plurality of braking levels further comprises:

determining a third braking level based on engine operating conditions.

11. An internal combustion engine having an engine controller including a computer readable storage medium having instructions stored thereon that direct the engine controller to perform a method of controlling the internal combustion engine when the engine is operating in an engine braking mode, the engine having at least one cylinder and an intake manifold that supplies a controllable airflow to the at least one cylinder, wherein when the engine is operating in the engine braking mode an exhaust valve for the cylinder is prematurely opened to dissipate power, the medium further comprising:

instructions for determining a desired mass airflow rate to the at least one cylinder when the engine is operating in the engine braking mode;

instructions for determining an actual mass airflow rate to the at least one cylinder when the engine is operating in the engine braking mode;

instructions for comparing the desired mass airflow rate to the actual mass airflow rate; and instructions for controlling the airflow based on the comparison such that the actual mass airflow rate tracks the desired mass airflow rate, wherein the instructions for determining the actual mass airflow rate further comprise:

instructions for determining an engine speed;

instructions for determining an intake manifold air pressure;

instructions for determining an intake manifold air temperature;

instructions for determining a number of braking cylinders;

instructions for determining a correction factor based on the number of braking cylinders; and instructions for determining the actual mass airflow rate based on the engine speed, the intake manifold air pressure, the intake manifold air temperature, and the correction factor.

12. The engine of claim 11 wherein the instructions for determining the desired mass airflow rate further comprise:

instructions for determining a desired braking level;

instructions for determining an engine speed; and instructions for determining the desired mass airflow rate based on the desired braking level, and the engine speed.

13. The engine of claim 11 wherein the instructions for controlling the airflow further comprise:

instructions for determining a mass airflow rate error based on the comparison;

instructions for determining a plurality of control terms; and instructions for controlling the airflow based on the mass airflow rate error and the plurality of control terms.

14. The engine of claim 13 wherein the medium further comprises:

instructions for determining a desired braking level;

instructions for determining an engine speed;

instructions for determining a feed forward term based on the desired braking level and the engine speed; and instructions for controlling the airflow based on the mass airflow rate error, the plurality of control terms, and the feed forward term.

15. An internal combustion engine having an engine controller including a computer readable storage medium having instructions stored thereon that direct the engine controller to perform a method of controlling the internal combustion engine when the engine is operating in an engine braking mode, the engine having at least one cylinder and an intake manifold that supplies a controllable airflow to the at least one cylinder, wherein when the engine is operating in the engine braking mode an exhaust valve for the cylinder is prematurely opened to dissipate power, the medium further comprising:

instructions for determining a desired mass airflow rate to the at least one cylinder when the engine is operating in the engine braking mode;

instructions for determining an actual mass airflow rate to the at least one cylinder when the engine is operating in the engine braking mode;

instructions for comparing the desired mass airflow rate to the actual mass airflow rate: and instructions for controlling the airflow based on the comparison such that the actual mass airflow rate tracks the desired mass airflow rate, wherein the engine includes a variable geometry turbocharger, and wherein the instructions for controlling the airflow further comprise:

instructions for varying the geometry of the turbocharger based on the comparison.

16. The engine of claim 15 wherein the instructions for varying the geometry of the turbocharger further comprise:

instructions for determining a braking turbocharger geometry based on the comparison of the desired mass air flow rate to the actual mass air flow rate;

instructions for determining a turbocharger actual speed;

instructions for establishing a turbocharger maximum speed;

instructions for comparing the turbocharger actual speed to the turbocharger maximum speed;

instructions for determining a limit turbocharger geometry based on the comparison of the turbocharger actual speed to the turbocharger maximum speed;

instructions for comparing the limit turbocharger geometry to the braking turbocharger geometry; and instructions for varying the geometry based on the comparison of the limit turbocharger geometry to the braking turbocharger geometry.

17. An internal combustion engine having an engine controller including a computer readable storage medium having instructions stored thereon that direct the engine controller to perform a method of controlling the internal combustion engine when the engine is operating in an engine braking mode, the engine having at least one cylinder and an intake manifold that supplies a controllable airflow to the at least one cylinder, wherein when the engine is operating in the engine braking mode an exhaust valve for the cylinder is prematurely opened to dissipate power, the medium further comprising:

instructions for determining a desired mass airflow rate to the at least one cylinder when the engine is operating in the engine braking mode;

instructions for determining an actual mass airflow rate to the at least one cylinder when the engine is operating in the engine braking mode:

instructions for comparing the desired mass airflow rate to the actual mass airflow rate; and instructions for controlling the airflow based on the comparison such that the actual mass airflow rate tracks the desired mass airflow rate, wherein the instructions for determining the desired mass airflow rate further comprise:

instructions for determining a plurality of braking levels based on engine operating conditions;

instructions for selecting a desired braking level from the plurality of braking levels;

instructions for determining an engine speed; and instructions for determining the desired mass air flow rate based on the desired braking level, and the engine speed.

18. The engine of claim 17 wherein the instructions for determining a plurality of braking levels further comprise:

instructions for determining a first braking level based on a position of a dash input switch.

19. The engine of claim 18 wherein the instructions for determining a plurality of braking levels further comprise:

instructions for determining a second braking level based on a status of a cruise control.

20. The engine of claim 19 wherein the instructions for determining a plurality of braking levels further comprise:

instructions for determining a third braking level based on engine operating conditions.

* * * * *